US011022144B2

(12) United States Patent
Hough et al.

(10) Patent No.: US 11,022,144 B2
(45) Date of Patent: Jun. 1, 2021

(54) DIFFUSER CASE ASSEMBLY

(71) Applicant: United Technologies Corporation, Farmington, CT (US)

(72) Inventors: Matthew Andrew Hough, West Simsbury, CT (US); John S. Tu, Agawam, MA (US); Stephen C. Harmon, East Hampton, CT (US); Paul F. Croteau, Columbia, CT (US); Russell B. Hanson, Jupiter, FL (US); Joshua C. Rathgeb, Glastonbury, CT (US)

(73) Assignee: Raytheon Technologies Corporation, Farmington, CT (US)

( * ) Notice: Subject to any disclaimer, the term of this patent is extended or adjusted under 35 U.S.C. 154(b) by 98 days.

(21) Appl. No.: 16/361,938

(22) Filed: Mar. 22, 2019

(65) Prior Publication Data

US 2020/0300103 A1 Sep. 24, 2020

(51) Int. Cl.
*F04D 29/54* (2006.01)
*F01D 9/02* (2006.01)

(52) U.S. Cl.
CPC ..... *F04D 29/542* (2013.01); *F01D 9/023* (2013.01); *F05D 2240/12* (2013.01)

(58) Field of Classification Search
CPC ..... F04D 29/54; F04D 29/541; F04D 29/542; F04D 29/544; F01D 9/023; F05D 2240/12
See application file for complete search history.

(56) References Cited

U.S. PATENT DOCUMENTS

| | | | | |
|---|---|---|---|---|
| 5,609,467 | A | 3/1997 | Lenhart et al. | |
| 6,513,330 | B1 * | 2/2003 | Rice | F04D 29/542 60/751 |
| 8,561,410 | B2 * | 10/2013 | Mulcaire | F04D 29/542 60/751 |
| 10,024,238 | B2 * | 7/2018 | Phillips | F02C 7/185 |
| 10,087,775 | B2 * | 10/2018 | Mulcaire | F04D 29/542 |
| 2003/0161718 | A1 * | 8/2003 | Nguyen | F01D 9/065 415/115 |
| 2014/0186167 | A1 | 7/2014 | Liles | |
| 2016/0090914 | A1 | 3/2016 | Lyons | |
| 2016/0265371 | A1 | 9/2016 | Dale | |
| 2019/0368737 | A1 * | 12/2019 | Dillard | F04D 29/542 |

FOREIGN PATENT DOCUMENTS

| | | |
|---|---|---|
| GB | 2281592 | 3/1995 |

OTHER PUBLICATIONS

EP search report for EP20153235.5 dated Jul. 8, 2020.

* cited by examiner

*Primary Examiner* — Richard A Edgar
(74) *Attorney, Agent, or Firm* — Getz Balich LLC

(57) ABSTRACT

A diffuser case assembly for a gas turbine engine includes a fairing disposed circumferentially about a longitudinal axis. The fairing defines a plurality of passages circumferentially spaced apart and forming at least a portion of a fluid path between a compressor and a combustor of the gas turbine engine. A diffuser frame includes a plurality of struts. Each of the plurality of struts is disposed between a pair of adjacent passages of the plurality of passages. The diffuser frame is configured to couple an inner diffuser case to an outer diffuser case.

18 Claims, 5 Drawing Sheets

DIFFUSER CASE ASSEMBLY

This invention was made with Government support awarded by the United States. The Government has certain rights in this invention.

BACKGROUND

1. Technical Field

This disclosure relates generally to gas turbine engines, and more particularly to diffuser case assemblies.

2. Background Information

During operation of a gas turbine engine, heated core gases flow from a compressor section to a combustor section where they are mixed with fuel and ignited. Elevated core gas temperatures may induce large thermal gradients on engine components in the core flowpath.

For example, during a transient acceleration from idle to takeoff power, a support structure for an inner diffuser case, forming part of the core flowpath, may rapidly reach takeoff metal temperatures. The resulting thermal gradient may create excessive stress concentrations at intersections of comparatively hotter and colder portions of the diffuser cases and associated support structure. The thermal stress concentrations are exacerbated by the need for the inner diffuser case structure to be stiff enough to support a shaft bearing of the gas turbine engine.

SUMMARY

According to an embodiment of the present disclosure, a diffuser case assembly for a gas turbine engine includes a fairing disposed circumferentially about a longitudinal axis. The fairing defines a plurality of passages circumferentially spaced apart and forming at least a portion of a fluid path between a compressor and a combustor of the gas turbine engine. A diffuser frame includes a plurality of struts. Each of the plurality of struts is disposed between a pair of adjacent passages of the plurality of passages. The diffuser frame is configured to couple an inner diffuser case to an outer diffuser case.

In the alternative or additionally thereto, in the foregoing embodiment, a space between each pair of adjacent passages of the plurality of passages defines a recessed portion of the fairing extending axially from an axial end of the fairing through a portion of the fairing.

In the alternative or additionally thereto, in the foregoing embodiment, the diffuser frame and the inner diffuser case form an integral component.

In the alternative or additionally thereto, in the foregoing embodiment, at least one of the struts is hollow.

In the alternative or additionally thereto, in the foregoing embodiment, the at least one hollow strut defines a channel extending radially through the strut.

In the alternative or additionally thereto, in the foregoing embodiment, the diffuser frame is physically independent of the fairing.

In the alternative or additionally thereto, in the foregoing embodiment, the diffuser frame is made of a first material and the fairing is made of a second material different than the first material.

In the alternative or additionally thereto, in the foregoing embodiment, the diffuser case assembly further includes at least one seal disposed between the fairing and the diffuser frame.

In the alternative or additionally thereto, in the foregoing embodiment, the diffuser case assembly further includes a sliding joint forming an interface between the fairing and the diffuser frame.

In the alternative or additionally thereto, in the foregoing embodiment, the sliding joint is configured to move radially in response to at least one of thermal expansion and contraction of the fairing in a radial direction.

In the alternative or additionally thereto, in the foregoing embodiment, the channel is configured to conduct a flow of fluid between a compartment radially outside the inner diffuser case to a compartment radially inside the inner diffuser case.

In the alternative or additionally thereto, in the foregoing embodiment, an auxiliary line extends through the channel.

In the alternative or additionally thereto, in the foregoing embodiment, the fairing is a single-piece casting.

According to another embodiment of the present disclosure, a diffuser case assembly for a gas turbine engine includes a fairing disposed circumferentially about a longitudinal axis and a diffuser frame including a plurality of hollow struts. The fairing defines a plurality of passages circumferentially spaced apart and forming at least a portion of a fluid path between a compressor and a combustor of the gas turbine engine and a space between each pair of adjacent passages of the plurality of passages. The space defines a recessed portion of the fairing extending axially from an axial end of the fairing through a portion of the fairing. Each strut of the plurality of struts defines a channel extending radially through the strut and each strut of the plurality of struts is disposed between a pair of adjacent passages of the plurality of passages. The diffuser frame is configured to couple an inner diffuser case to an outer diffuser case.

In the alternative or additionally thereto, in the foregoing embodiment, the diffuser frame and the inner diffuser case form an integral component.

In the alternative or additionally thereto, in the foregoing embodiment, the diffuser frame is physically independent of the fairing.

According to another embodiment of the present disclosure, a gas turbine engine includes an inner diffuser case, an outer diffuser case, and a diffuser case assembly coupling the inner diffuser case to the outer diffuser case. The diffuser case assembly includes a fairing disposed circumferentially about a longitudinal axis. The fairing defines a plurality of passages circumferentially spaced apart and forming at least a portion of a fluid path between a compressor and a combustor of the gas turbine engine. A diffuser frame includes a plurality of struts. Each of the plurality of struts is disposed between a pair of adjacent passages of the plurality of passages.

In the alternative or additionally thereto, in the foregoing embodiment, the diffuser frame and the inner diffuser case form an integral component.

In the alternative or additionally thereto, in the foregoing embodiment, the diffuser frame is physically independent of the fairing.

In the alternative or additionally thereto, in the foregoing embodiment, the diffuser frame is made of a first material and the fairing is made of a second material different than the first material.

The present disclosure, and all its aspects, embodiments and advantages associated therewith will become more readily apparent in view of the detailed description provided below, including the accompanying drawings.

DETAILED DESCRIPTION

Figure 1:
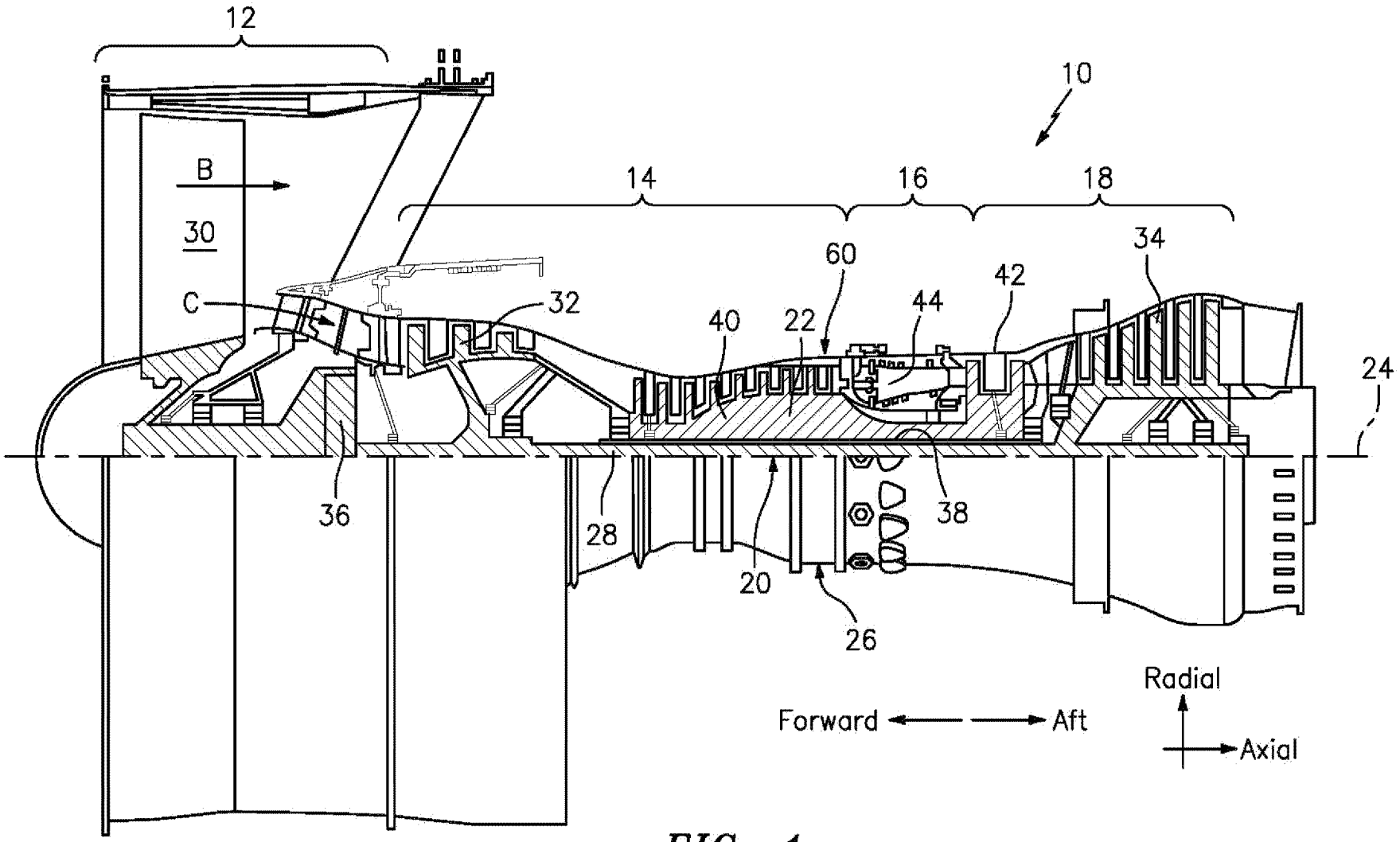
FIG. 1 illustrates a schematic cross-sectional view of a gas turbine engine.

It is noted that various connections are set forth between elements in the following description and in the drawings. It is noted that these connections are general and, unless specified otherwise, may be direct or indirect and that this specification is not intended to be limiting in this respect. A coupling between two or more entities may refer to a direct connection or an indirect connection. An indirect connection may incorporate one or more intervening entities.

FIG. 1 schematically illustrates a gas turbine engine 10. The gas turbine engine 10 is disclosed herein as a two-spool turbofan that generally incorporates a fan section 12, a compressor section 14, a combustor section 16, and a turbine section 18. The fan section 12 drives air along a bypass flowpath B while the compressor section 14 drives air along a core flowpath C for compression and communication into the combustor section 16 then expansion through the turbine section 18. Although depicted as a turbofan gas turbine engine in the disclosed non-limiting embodiment, it should be understood that the concepts described herein are not limited to use with turbofans as the teachings may be applied to other types of turbine engines including three-spool architectures.

The gas turbine engine 10 generally includes a low-speed spool 20 and a high-speed spool 22 mounted for rotation about an engine central longitudinal axis 24 relative to an engine static structure 26. It should be understood that various bearing systems at various locations may alternatively or additionally be provided.

The low-speed spool 20 generally includes an inner shaft 28 that interconnects a fan 30, a low-pressure compressor 32 and a low-pressure turbine 34. The inner shaft 28 is connected to the fan 30 through a geared architecture 36 to drive the fan 30 at a lower speed than the low-speed spool 20. The high-speed spool 22 includes an outer shaft 38 that interconnects a high-pressure compressor 40 and high-pressure turbine 42. A combustor 44 is arranged between the high-pressure compressor 40 and high-pressure turbine 42.

The core airflow is compressed by the low-pressure compressor 32 then the high-pressure compressor 40, passed through a diffuser case assembly 60, mixed and burned with fuel in the combustor 44, and then expanded over the high-pressure turbine 42 and the low-pressure turbine 34. The turbines rotationally drive the respective low-speed spool 20 and high-speed spool 22 in response to the expansion.

Figure 2:
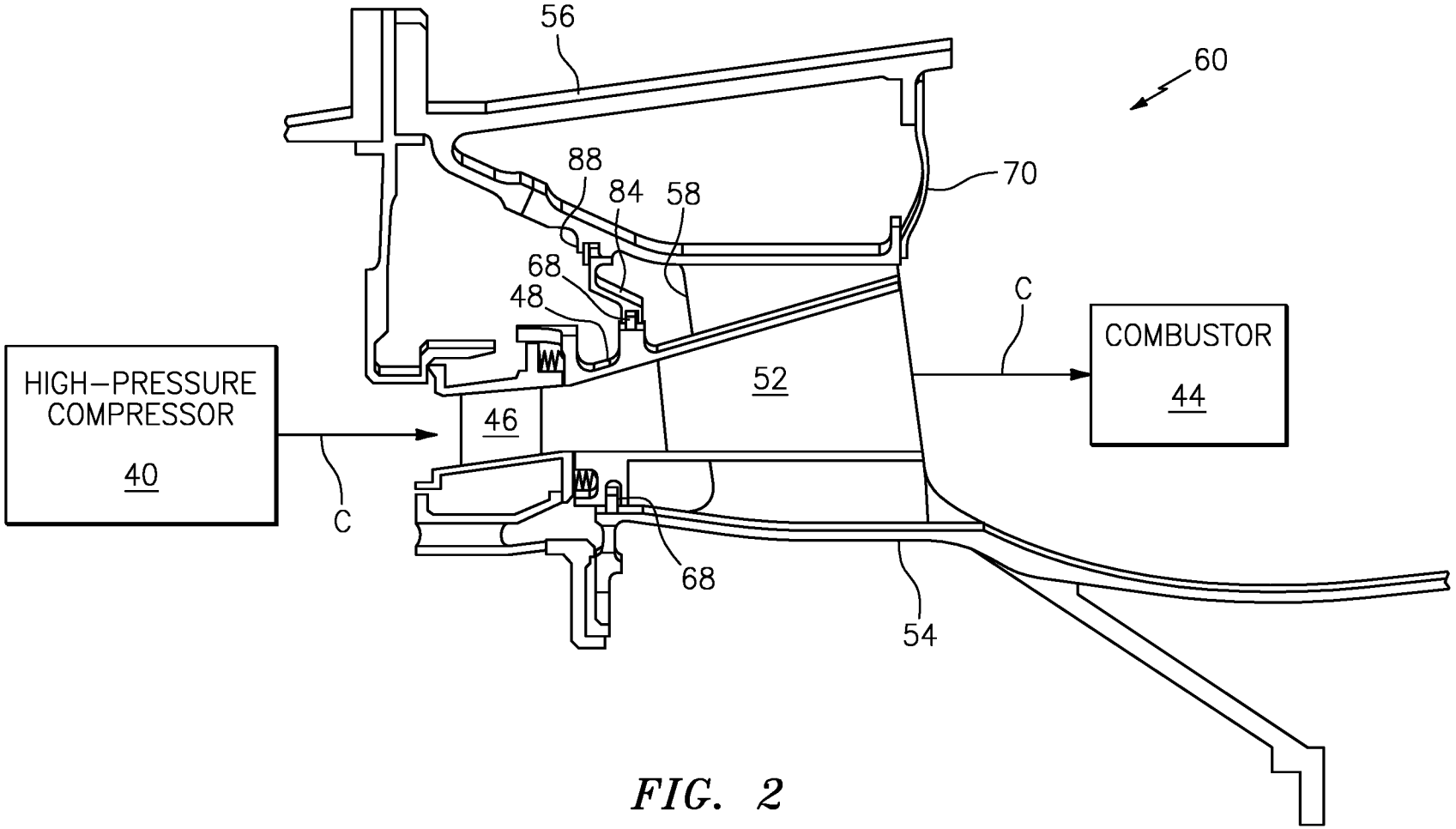
FIG. 2 illustrates a cross-sectional side view of a diffuser case assembly of a gas turbine engine.
Figure 3:
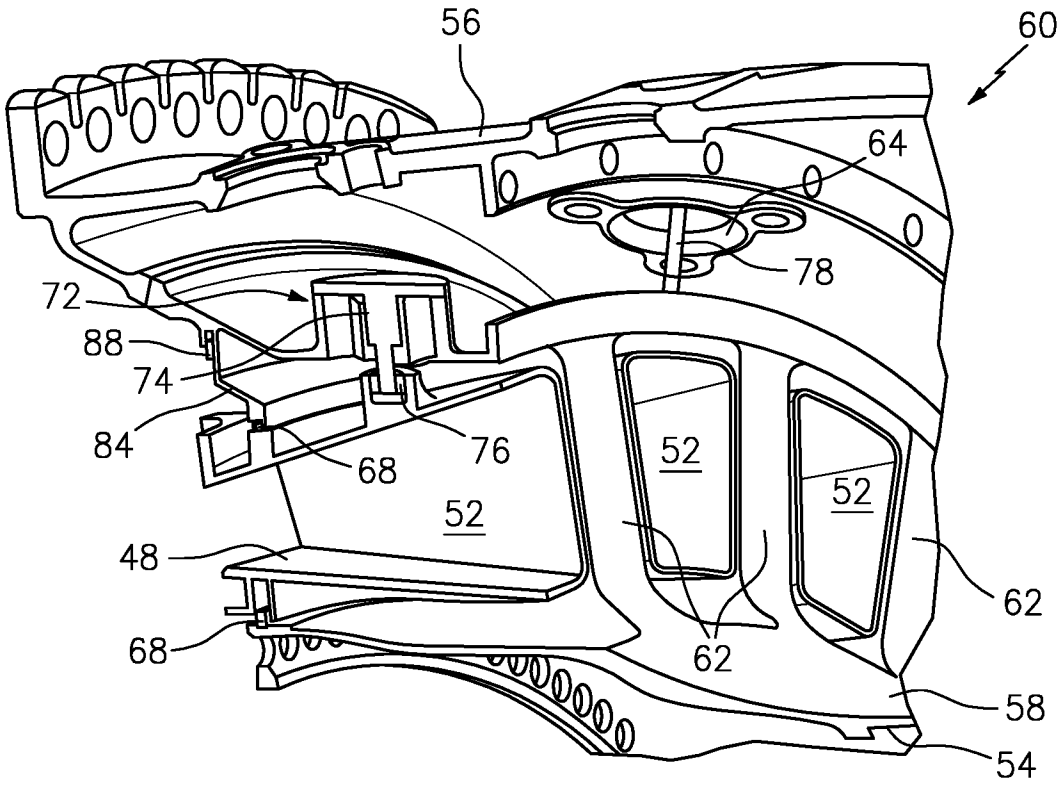
FIG. 3 illustrates a cross-sectional perspective view of a portion of the diffuser case assembly of FIG. 2.

FIG. 2 illustrates a cross-sectional view of the diffuser case assembly 60 of the gas turbine engine 10 illustrating the high-pressure compressor 40, the combustor 44, and the core flowpath C therebetween. An exit guide vane 46 is positioned within the core flowpath C immediately aft of the high-pressure compressor 40 and alters flow characteristics of core gases exiting the high-pressure compressor 40, prior to the gas flow entering the combustor 44.

Referring to FIGS. 2-5, a fairing 48 is disposed immediately aft of the exit guide vane 46 and forms at least a portion of the core flowpath C (i.e., providing fluid communication) between the high-pressure compressor 40 and the combustor 44. The fairing 48 is disposed circumferentially (e.g., annularly) about the longitudinal axis 24 of FIG. 1. The fairing 48 includes a plurality of passages 52 extending (e.g., generally axially) through the fairing 48 and configured to form the core flowpath C through the fairing 48 between the high-pressure compressor 40 and the combustor 44. The fairing 48 further includes a plurality of recessed portions 50 defined between adjacent passages 52 of the fairing 48. For example, the recessed portions 50 may extend axially from an aft axial end (i.e., an end proximate the combustor 44) of the fairing 48 through a portion of the fairing 48. In some embodiments, each recessed portion of the plurality of recessed portions 50 may be disposed between each respective pair of circumferentially adjacent passages of the plurality of passages 52. In some embodiments, the fairing 48 may be configured as a single piece, for example a single-piece casting or a fully machined component. In some other embodiments, the fairing 48 may be configured as a plurality of circumferential segments subsequently assembled (e.g., welded or otherwise attached together) to form the fairing 48.

Annular inner and outer diffuser cases 54, 56 radially house the fairing 48. The outer diffuser case 56 is disposed radially outward of the fairing 48. The inner diffuser case 54 is disposed radially inward of the fairing 48. In some embodiments, the inner and outer diffuser cases 54, 56 may extend generally axially through all or part of the compressor section 14 and/or the combustor section 16. The inner and outer diffuser cases 54, 56 mechanically support structures of the gas turbine engine 10, for example, the inner diffuser case 54 may support a shaft bearing of the gas turbine engine 10.

The inner diffuser case 54 includes a diffuser frame 58 which extends between and couples the inner diffuser case 54 and the outer diffuser case 56. The inner diffuser case 54, outer diffuser case 56, and diffuser frame 58 form a diffuser case assembly 60 (i.e., a "cold structure" in contrast to the "hot" fairing 48). In some embodiments, the diffuser frame 58 and the inner diffuser case 54 may form a single integral component.

The diffuser frame 58 includes a plurality of circumferentially spaced-apart struts 62 with each strut of the plurality of struts 62 configured to radially extend through the fairing 48 between a pair of adjacent passages of the plurality of passages 52. For example, each strut of the plurality of struts 62 may be disposed within a respective recessed portion of the plurality of recessed portions 50. In some embodiments, each pair of adjacent passages of the plurality of passages 52 may correspond to a respective strut of the plurality of struts 62, i.e., a strut of the plurality of struts 62 may radially extend through the fairing 48 between each pair of adjacent passages of the plurality of passages 52. In other embodiments, a quantity of the plurality of struts 62 may be less than a quantity of the plurality of passages 52. For example, each strut of the plurality of struts 62 may radially extend through the fairing 48 between each other pair, each third pair, etc. of adjacent passages of the plurality of passages 52 or any other suitable configuration of the plurality of struts 62 and the plurality of passages 52. This configuration may provide for simpler assembly by allowing the diffuser case assembly 60 to be installed and then allowing the fairing 48 to be installed between the plurality of struts 62 from the forward end (see, e.g., FIG. 5). In some embodiments, the diffuser frame 58 may be physically independent of the fairing 48 (i.e., there is no physical contact between the diffuser frame 58 and the fairing 48).

Figure 4:
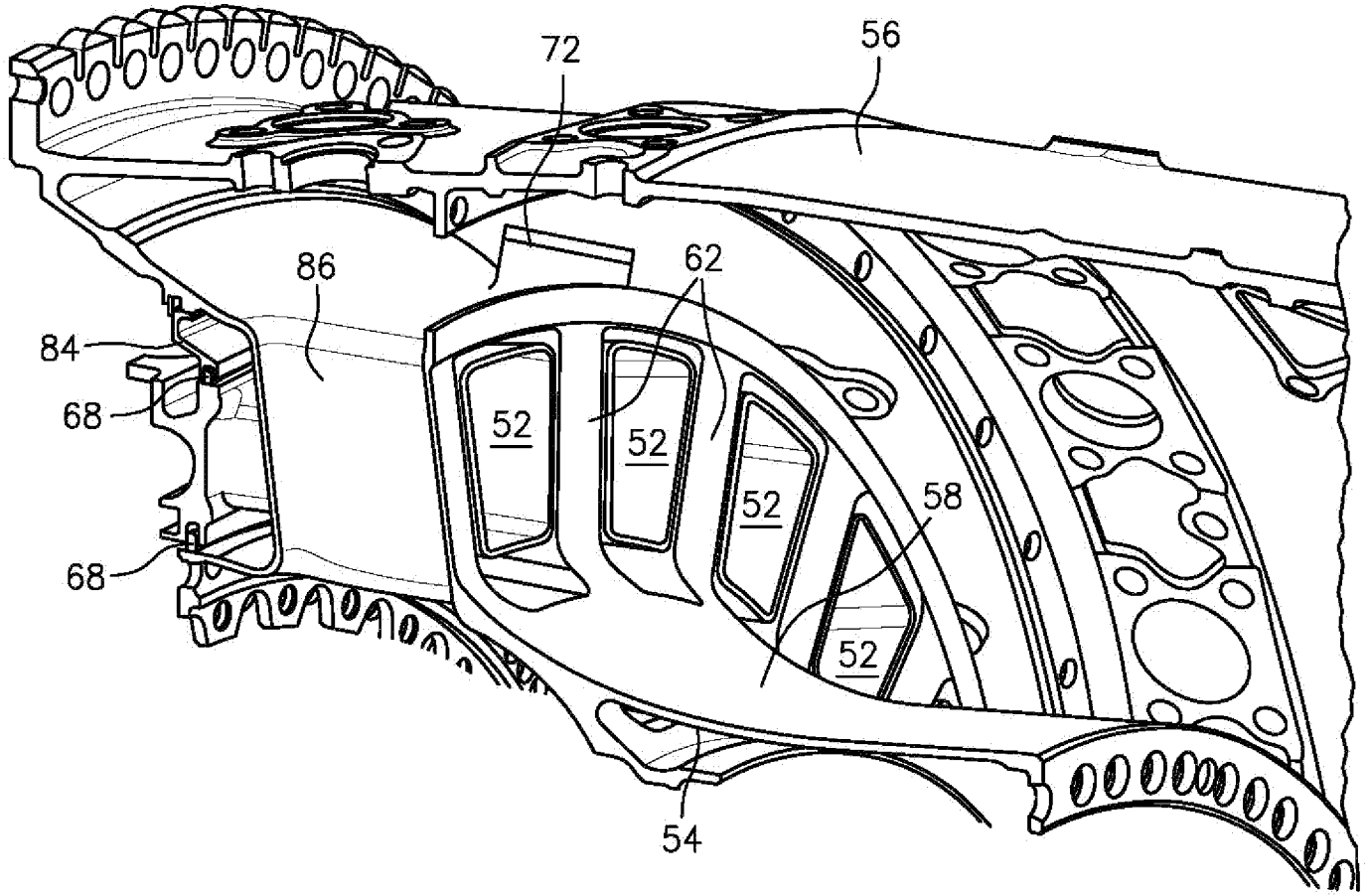
FIG. 4 illustrates a cross-sectional perspective view of a portion of the diffuser case assembly of FIG. 2.
Figure 5:
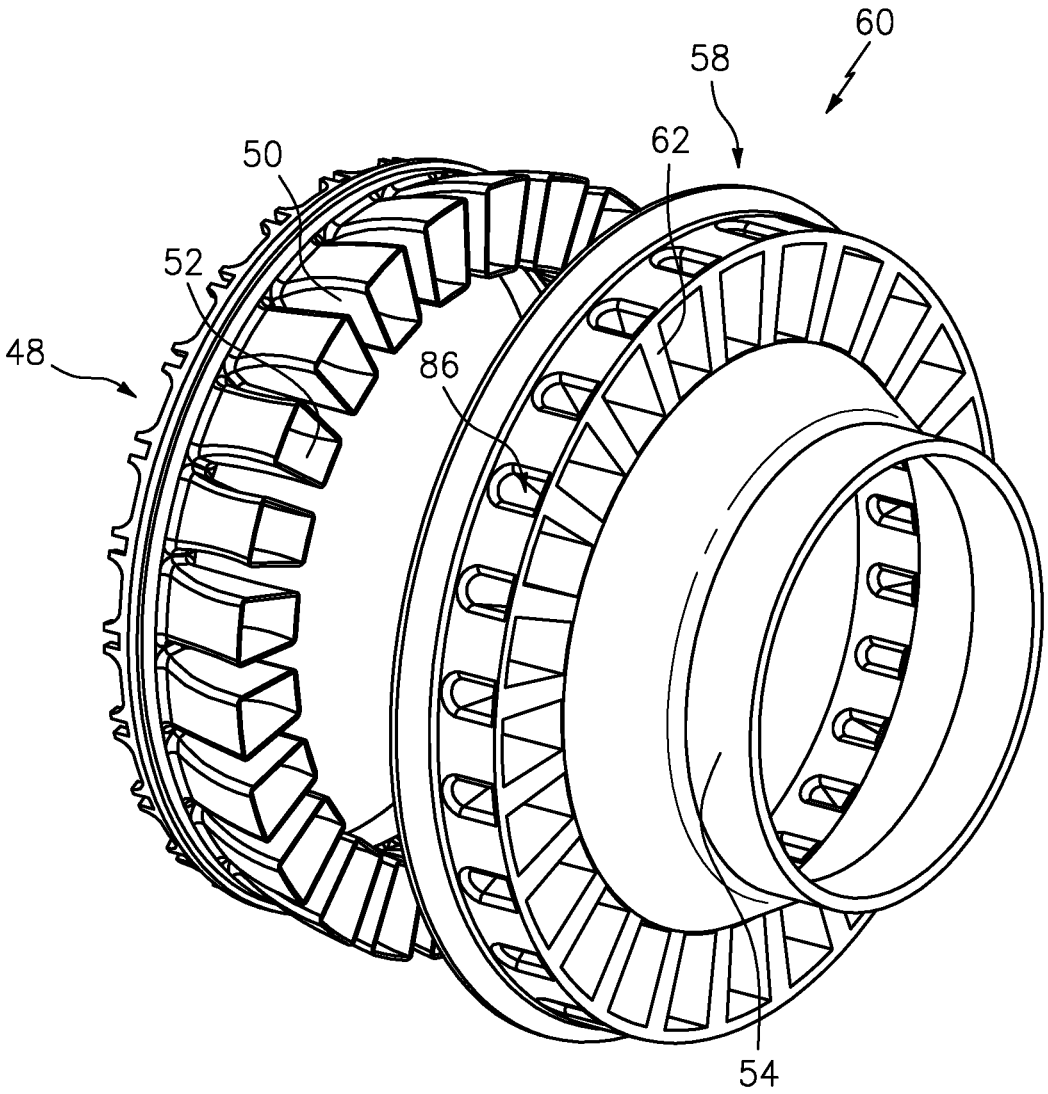
FIG. 5 illustrates an exploded view of the diffuser case assembly of FIG. 2.

As shown in FIGS. 4 and 5, in some embodiments, at least one strut of the plurality of struts 62 may be hollow, thereby defining a channel 86 extending radially through the at least one hollow strut. A hollow configuration of the plurality of struts 62 may provide a reduction in the weight of the diffuser case assembly 60. The channel 86 may be configured to conduct a flow of fluid (e.g., cooling air), for example, between a compartment radially outside the inner diffuser case 54 to a compartment radially inside the inner diffuser case 54.

During operational transients of the gas turbine engine 10, the fairing 48 may experience an increased flow of hot gases along the core flowpath C. For example, during a transient acceleration from idle to takeoff power, the increase flow of hot gases through the fairing 48 may cause the fairing 48 to rapidly increase in temperature. Separation of the core flowpath C from the diffuser case assembly 60 (i.e., the "cold structure") by the fairing 48 may prevent the development of large thermal gradients across one or both of the diffuser case assembly 60 and the fairing 48. As a result, the temperature of the fairing 48 may increase while the diffuser case assembly 60 remains at a more constant, lower temperature compared to the fairing 48. Similarly, the fairing 48 may achieve a more constant, higher temperature compared to the diffuser case assembly 60. Thus, thermal stress concentrations, for example, between the diffuser frame 58 and the inner diffuser case 54 or across the fairing 60 may be reduced as a result of the minimized thermal gradients.

The fairing 48 may include one or more seals 68 between the fairing 48 and the diffuser case assembly 60. In the illustrated embodiment, the fairing 48 includes a seal 68 between the fairing 48 and the inner diffuser case 54. The fairing 48 includes an additional seal 68 between the fairing 48 and a seal carrier 84. The seals 68 may be configured to maintain the seal between the diffuser case assembly 60 and the fairing 48 as the fairing 48 expands and contracts (e.g., in a radial, axial, etc. direction), independent of the diffuser case assembly 60, as a result of changes in the temperature of the fairing 48. The seals 68 may be configured, for example, as piston seals or any other suitable type of seal. In other embodiments, the number and location of the seals 68 may vary according to diffuser case assembly 60 configuration. In some embodiments, the seal carrier 84 may include a retaining ring 88 configured to maintain the sealing function of the seal carrier 84 in response to radial movement of the fairing 48. In some embodiments, the diffuser case assembly 60 may include a mixing seal 70 configured to provide a seal between an aft portion of the diffuser frame 58 and the outer diffuser case 56.

The diffuser case assembly 60 may include at least one sliding joint 72 to provide a support interface between the fairing 48 and the diffuser case assembly 60, while still allowing the fairing 48 to thermally expand and contract. In the illustrated embodiment, the at least one sliding joint 72 includes an alignment pin 74 extending radially inward from the diffuser frame 58. The alignment pin 74 mates with a pin bushing 76 disposed on the fairing 48 (i.e., a pin boss configuration), thereby movably supporting the fairing 48 by allowing relative radial movement between the fairing 48 and the alignment pin 74. For example, the alignment pin 74 may move radially within the pin bushing 76 in response to at least one of thermal expansion and contraction of the fairing 48 in a radial direction.

As discussed above, the gas turbine engine 10 transients may cause the fairing 48 to thermally expand or contract while the diffuser case assembly 60 maintains a more consistent and cooler temperature. Accordingly, in some embodiments, the diffuser frame 58 may be made from a first material while the fairing 48 is made from a second material, different than the first material. For example, the fairing 48 may be made from a high-temperature resistant material (e.g., waspaloy, nickel-based alloys, ceramics, ceramic matrix composites, etc.) while the diffuser frame 58 is made from a comparatively stronger material (e.g., Inconel 718, titanium, etc.) for improved support and structural stiffness of the diffuser case assembly 60.

In some embodiments, one or more auxiliary lines 78 may extend through one or both of an aperture 64 of the outer diffuser case 56 and a channel 86 of the plurality of struts 62. For example, the at least one auxiliary line 78 may be a bearing service line configured to convey oil to or from a bearing of the gas turbine engine 10.

While various aspects of the present disclosure have been disclosed, it will be apparent to those of ordinary skill in the art that many more embodiments and implementations are possible within the scope of the present disclosure. For example, the present disclosure as described herein includes several aspects and embodiments that include particular features. Although these particular features may be described individually, it is within the scope of the present disclosure that some or all of these features may be combined with any one of the aspects and remain within the scope of the present disclosure. Accordingly, the present disclosure is not to be restricted except in light of the attached claims and their equivalents.

What is claimed is:

1. A diffuser case assembly for a gas turbine engine comprising:

an inner diffuser case;

an outer diffuser case;

a fairing disposed circumferentially about a longitudinal axis, the fairing defining a plurality of passages circumferentially spaced apart and forming at least a portion of a fluid path between a compressor and a combustor of the gas turbine engine; and a diffuser frame comprising a plurality of struts each extending between an outer radial strut end and an inner radial strut end, each of the plurality of struts disposed between a pair of adjacent passages of the plurality of passages, the diffuser frame coupling the inner diffuser case to the outer diffuser case, the diffuser frame further comprising an annular frame member which extends from the outer radial strut end to an axial frame end of the annular frame member in contact with the outer diffuser case;

wherein at least one strut of the plurality of struts is hollow and the at least one hollow strut defines a channel extending radially through the at least one hollow strut from the outer radial strut end to the inner radial strut end.

2. The diffuser case assembly of claim 1, wherein a space between each pair of adjacent passages of the plurality of passages defines a recessed portion of the fairing extending axially from an axial end of the fairing through a portion of the fairing.

3. The diffuser case assembly of claim 2, wherein the diffuser frame and the inner diffuser case form an integral component.

4. The diffuser case assembly of claim 1, wherein the diffuser frame is physically independent of the fairing.

5. The diffuser case assembly of claim 1, wherein the diffuser frame is made of a first material and the fairing is made of a second material different than the first material, the first material having a greater strength than the second material.

6. The diffuser case assembly of claim 1, further comprising at least one seal disposed between the fairing and the diffuser frame.

7. The diffuser case assembly of claim 1 further comprising a sliding joint forming an interface between the fairing and the diffuser frame, the sliding joint comprising an alignment pin extending radially inward from the diffuser frame and a pin bushing disposed on the fairing.

8. The diffuser case assembly of claim 7, wherein the sliding joint is configured to move radially in response to at least one of thermal expansion and contraction of the fairing in a radial direction.

9. The diffuser case assembly of claim 1, wherein the channel is configured to conduct a flow of fluid between a compartment radially outside the inner diffuser case to a compartment radially inside the inner diffuser case.

10. The diffuser case assembly of claim 1, wherein an auxiliary line extends through the channel.

11. The diffuser case assembly of claim 1, wherein the fairing is a single-piece casting.

12. A diffuser case assembly for a gas turbine engine comprising:

an inner diffuser case;

and outer diffuser case;

a fairing disposed circumferentially about a longitudinal axis, the fairing defining:

a plurality of passages circumferentially spaced apart and forming at least a portion of a fluid path between a compressor and a combustor of the gas turbine engine; and a space between each pair of adjacent passages of the plurality of passages, the space defining a recessed portion of the fairing extending axially from an axial end of the fairing through a portion of the fairing;

a diffuser frame coupling the inner diffuser case to the outer diffuser case, the diffuser frame comprising a plurality of hollow struts each extending between an outer radial strut end and an inner radial strut end, each strut of the plurality of struts defining a channel extending radially through each strut from the outer radial strut end to the inner radial strut end, and each strut of the plurality of struts disposed between a pair of adjacent passages of the plurality of passages; and an annular compartment located radially outside of the outer radial strut end, the annular compartment defined by the diffuser frame, the outer diffuser case, and a mixing seal in contact with the diffuser frame and the outer diffuser case; wherein the channel of each strut of the plurality of struts provides fluid communication between the annular compartment and an interior of the inner diffuser case.

13. The diffuser case assembly of claim 12, wherein the diffuser frame and the inner diffuser case form an integral component.

14. The diffuser case assembly of claim 12, wherein the diffuser frame is physically independent of the fairing.

15. A gas turbine engine comprising:

an inner diffuser case;

an outer diffuser case; and a diffuser case assembly coupling the inner diffuser case to the outer diffuser case, the diffuser case assembly comprising:

a fairing disposed circumferentially about a longitudinal axis, the fairing defining a plurality of passages circumferentially spaced apart and forming at least a portion of a fluid path between a compressor and a combustor of the gas turbine engine;

a diffuser frame comprising a plurality of struts each extending between an outer radial strut end and an inner radial strut end, each of the plurality of struts disposed between a pair of adjacent passages of the plurality of passages, the diffuser frame further comprising an annular frame member which extends from the outer radial strut end to an axial frame end of the annular frame member in contact with the outer diffuser case; and an annular compartment located radially outside of the outer radial strut end, the annular compartment defined by the diffuser frame, the outer diffuser case, and a mixing seal in contact with the diffuser frame and the outer diffuser case;

wherein at least one strut of the plurality of struts is hollow and the at least one hollow strut defines a channel extending radially through the at least one hollow strut from the outer radial strut end to the inner radial strut end, and wherein the channel provides fluid communication between the annular compartment and an interior of the inner diffuser case.

16. The gas turbine engine of claim 15, wherein the diffuser frame and the inner diffuser case form an integral component.

17. The gas turbine engine of claim 15, wherein the diffuser frame is physically independent of the fairing.

18. The gas turbine engine of claim 15, wherein the diffuser frame is made of a first material and the fairing is made of a second material different than the first material, the first material having a greater strength than the second material.

* * * * *